United States Patent [19]

Hashish et al.

[11] Patent Number: 4,936,059

[45] Date of Patent: Jun. 26, 1990

[54] ABRASIVE SWIVEL ASSEMBLY AND METHOD

[75] Inventors: Mohamed Hashish, Kent; Mark Marvin, Tacoma, both of Wash.

[73] Assignee: Flow Industries, Inc., Kent, Wash.

[21] Appl. No.: 357,060

[22] Filed: May 25, 1989

Related U.S. Application Data

[62] Division of Ser. No. 120,865, Nov. 16, 1987, Pat. No. 4,854,091.

[51] Int. Cl.[5] ..... B24C 5/04

[52] U.S. Cl. ..... 51/439; 51/436; 175/424; 175/67

[58] Field of Search ..... 51/439, 411, 410, 321, 51/436; 175/424, 67, 17

[56] References Cited

U.S. PATENT DOCUMENTS 3,109,262 11/1963 Weaver et al. ..... 51/411
4,708,214 11/1987 Krawza et al. ..... 175/424

FOREIGN PATENT DOCUMENTS 0462527 3/1930 Fed. Rep. of Germany ..... 51/436
0882152 5/1943 France ..... 51/411

*Primary Examiner*—Robert Rose
*Attorney, Agent, or Firm*—Flehr, Hohbach, Test, Albritton & Herbert

[57] ABSTRACT

An abrasive swivel assembly for providing a rotating, particle-laden fluid stream and, ultimately, a rotating particle-laden fluid jet is disclosed herein. This assembly includes a tubular arrangement for providing a particle-free stream of fluid, a swivel assembly for rotating a section of the tubular arrangement, and a tubular end section for introducing solid particles into the particle-free fluid stream at a point along the rotating tubular section, whereby to produce a particle-laden fluid stream. This last-mentioned stream can then be used in combination with a cooperating nozzle arrangement for providing a rotating particle-laden fluid jet. In an actual working embodiment, the fluid stream is of sufficiently high pressure so that the abrasive jet can be used as a cutting jet.

7 Claims, 5 Drawing Sheets

ABRASIVE SWIVEL ASSEMBLY AND METHOD

This is a division of application Ser. No. 120,865 filed Nov. 16, 1987, now Pat. Ser. No. 4,854,091.

The present invention relates generally to abrasive swivels and more particularly to a swivel arrangement especially suitable for use in providing a rotating, particle-laden fluid stream and, ultimately, a high pressure, abrasive fluid cutting jet in a specific embodiment.

Techniques for providing high and ultra-high pressure particle-laden liquid cutting jets that do not rotate are well known in the art. One example is illustrated in Hashish, U.S. Pat. Ser. No. 4,648,215. At the same time, rotating swivel arrangements for providing rotating streams of particle-free fluid, even high-pressure applications, are well known in the art. See Hashish et al. U.S. Pat. Ser. No. 4,669,760. However, to date, applicants are not aware of any type of swivel assembly for use in providing a rotating, particle-laden stream of fluid. They have found there to be a great need for such an assembly, especially one capable of operating at high and ultra-high pressures for use in providing abrasive fluid cutting jets that can be rotated or oscillated back and forth. Applicants have found that there are many cutting applications where abrasive cutting jets that rotate or oscillate back and forth are essential to use. In view of the foregoing, it is an object of the present invention to provide a swivel assembly especially designed for use in providing a rotating, particle-laden fluid stream.

A more particular object of the present invention is to provide an uncomplicated and reliable abrasive swivel assembly.

Another particular object of the present invention is to provide an abrasive swivel assembly which is especially suitable for use in producing high pressure, rotating abrasive fluid cutting jets for use in cutting through soil rocks and even harder material such as concrete and steel reinforced concrete.

Still another particular object of the present invention is to provide an abrasive swivel for use with high pressure jets designed to minimize wear to its various components which are exposed to particulate material.

Yet another particular object of this invention is to provide an abrasive swivel assembly in which particulate material is introduced into a stream of particle-free fluid with minimal interruption to the flow of the fluid and without creating any clogs or any significant turbulence.

As will be seen hereinafter, the abrasive swivel assembly disclosed herein includes means for containing a particle-free stream of fluid, means for rotating the stream containing means about a given axis, and means for introducing particles into the rotating stream containing means and ultimately into the stream itself, whereby to be capable of producing a rotating, particle-laden fluid jet from the particle-laden stream. The jet itself can be provided by, for example, connecting the particle-laden stream in fluid communication with a rotating nozzle disposed in an offset position with respect to its axis of rotation.

In one embodiment of the present invention, an end section of a tube carrying the particle-free fluid stream is disposed within a rotating housing which serves to receive particles therein and combine the particles with the stream for providing the particle-laden streams. The housing also provides a rotating nozzle through which the particle-laden stream passes in order to create the rotating jet.

In another embodiment of the present invention, the abrasive swivel assembly comprises tube means including a straight tubular section thereof for containing within its interior a stream of particle-free fluid which flows from an upstream pressurized source of the fluid through the tube means including its straight section. Means are provided for rotating the straight tubular section about its own longitudinal axis and means are provided for introducing solid particles into the particle-free fluid stream at a point along the rotating straight tubular section, whereby to produce a particle-laden fluid stream which, like in the first recited embodiment, will be ultimately used to produce a rotating abrasive fluid cutting jet.

In this second embodiment, the swivel assembly preferably includes sleeve means defining a longitudinally extending annular cavity which circumscribes a segment of the straight tubular section of the tube means and which is placed in fluid communication with the interior of the tubular means. The sleeve means also serves to provide at least one entry port in fluid communication with the cavity for directing particles from an external supply into the cavity for passage from there into the particle-free stream. The annular cavity defining sleeve means includes two parts, a rotating part defining one longitudinal portion of the annular cavity and a second, stationary part which defines a second longitudinal portion of the cavity and which also includes the particle entry port. The cross-sectional areas of the annular cavity and the entry port and the area of the opening from the entry port into the cavity preferably vary by at most a factor of two. In this way, the particles enter and then pass through the cavity and ultimately combine with the particle-free fluid stream in a smooth, relatively turbulent free manner without clogging or otherwise disrupting the flow of fluid or particles within the swivel assembly.

The present invention will be described in more detail hereinafter in conjunction with the drawings, wherein.

Figure 1:
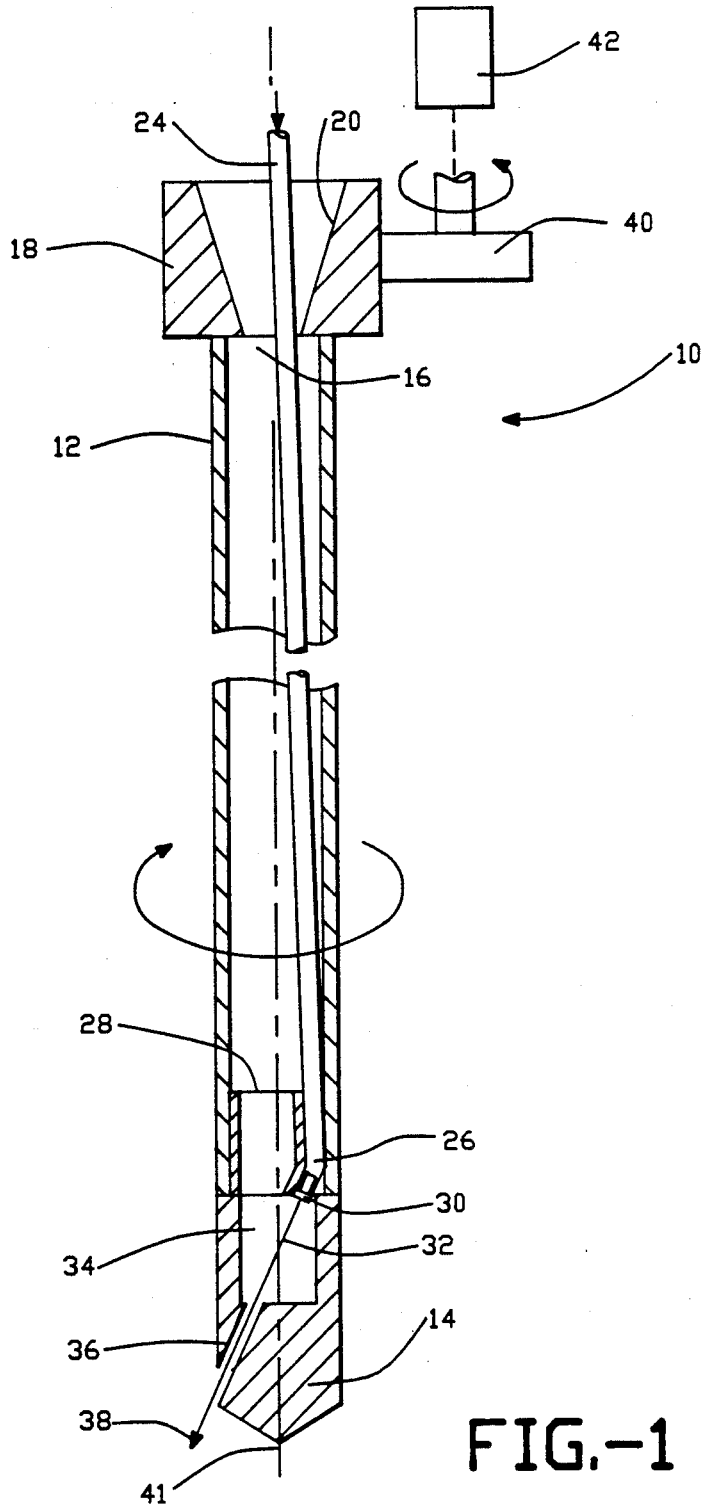
FIG. 1 is a longitudinal sectional view of a device which employs an abrasive swivel assembly designed in accordance with one embodiment of this invention.

Turning now to the drawings, attention is first directed to FIG. 1 which illustrates an assembly for providing a rotating, particle-laden fluid stream. For purposes of convenience, this assembly, which is generally indicated by the reference numeral 10, will be referred to merely as an abrasive swivel assembly. This assembly is termed in some applications as a deep kerfing tool because it enters the cut it makes to cut it deeper. As illustrated in FIG. 1, swivel assembly 10 includes a tubular housing 12 having a bottom closure 14 and opened top end 16 which fixedly supports a funnel 18.

The funnel includes a funnel-shaped entry port 20 disposed in coaxial relationship with the axis of the housing.

Still referring to FIG. 1, abrasive swivel assembly 10 also includes a tubular arrangement including a straight tubular end section 24 extending from a source of pressurized fluid (not shown), for example water, under pressure to a point defined by the free end of tubular section 24 within housing 12. More specifically, as seen in FIG. 1, tubular section 24 extends into housing 12 at an acute angle with the axis of the housing and its free end which is generally indicated at 26 is held fixed against the sidewall of the housing by means of spacing block 28. For reasons to become apparent hereinafter, the spacing block is configured to allow particulate material to freely flow past it within the housing. A nozzle 30 is disposed within free end 26 of tubular section 24. In that way, a stream of particle-free pressurized fluid flows through the tubular arrangement including straight section 24 from its source to and through nozzle 30 so as to produce an angled jet 32 of particle-free fluid into and across the lowermost interior section 34 of the housing 12 below the nozzle and block 28. For reasons to be described below, the bottom closure 14 of housing 12 includes an open-ended passageway 36 opening at one end into interior 34 of housing 12 and opening to the ambient surroundings at its other end. As seen in FIG. 1 the passageway is positioned in axial alignment with stream 32 and therefore angle with respect to the axis of housing 12.

Having described most of abrasive swivel assembly 10 from a structural standpoint, attention is now directed to the way in which this assembly produces a rotating, particle-laden (abrasive) fluid cutting jet at the ambient or outlet end of its passageway 36, as indicated by arrow 38. To this end, it should first be noted that housing 12 is caused to rotate about its own longitudinal axis 40 by any suitable means diagrammatically represented by a rotating drive roller 40 and drive motor 42. In this diagrammatic illustration, the drive roller is placed in engagement via belt or gear or simply friction with the outer surface of funnel member 18. Rotation of housing 12 about its longitudinal axis causes the free end 26 of tubular section 24 and nozzle 30 to rotate about a circle concentric with axis 41. This, in turn, causes particle-free stream 32 and passageway 36 to rotate about longitudinal axis 40. At the same time, particles may be introduced into housing 12 through entry port 20 where the particles so introduced are entertained by the suction of the jet 32 as it flows through the passageway 36 or fall downward by gravity past block 28 and into lowermost interior portion 34. At that point, the particles are drawn into passageway 28 by particle-free jet 32 for passage with the latter through passageway 36. As the particles enter the passageway, they mix with the fluid flowing therethrough, ultimately providing particle-laden fluid jet 38. The pressure of the fluid, for example water, at its source is preferably sufficiently high for example, on the order of 500 to 60,000 lbs/inch psi, so that the output j®t 38 may function as a cutting jet. Moreover, because of rotation of passageway 36, the output jet rotates with it. Thus, swivel assembly 10 is capable of ultimately providing a rotating abrasive fluid cutting jet.

Figure 2:
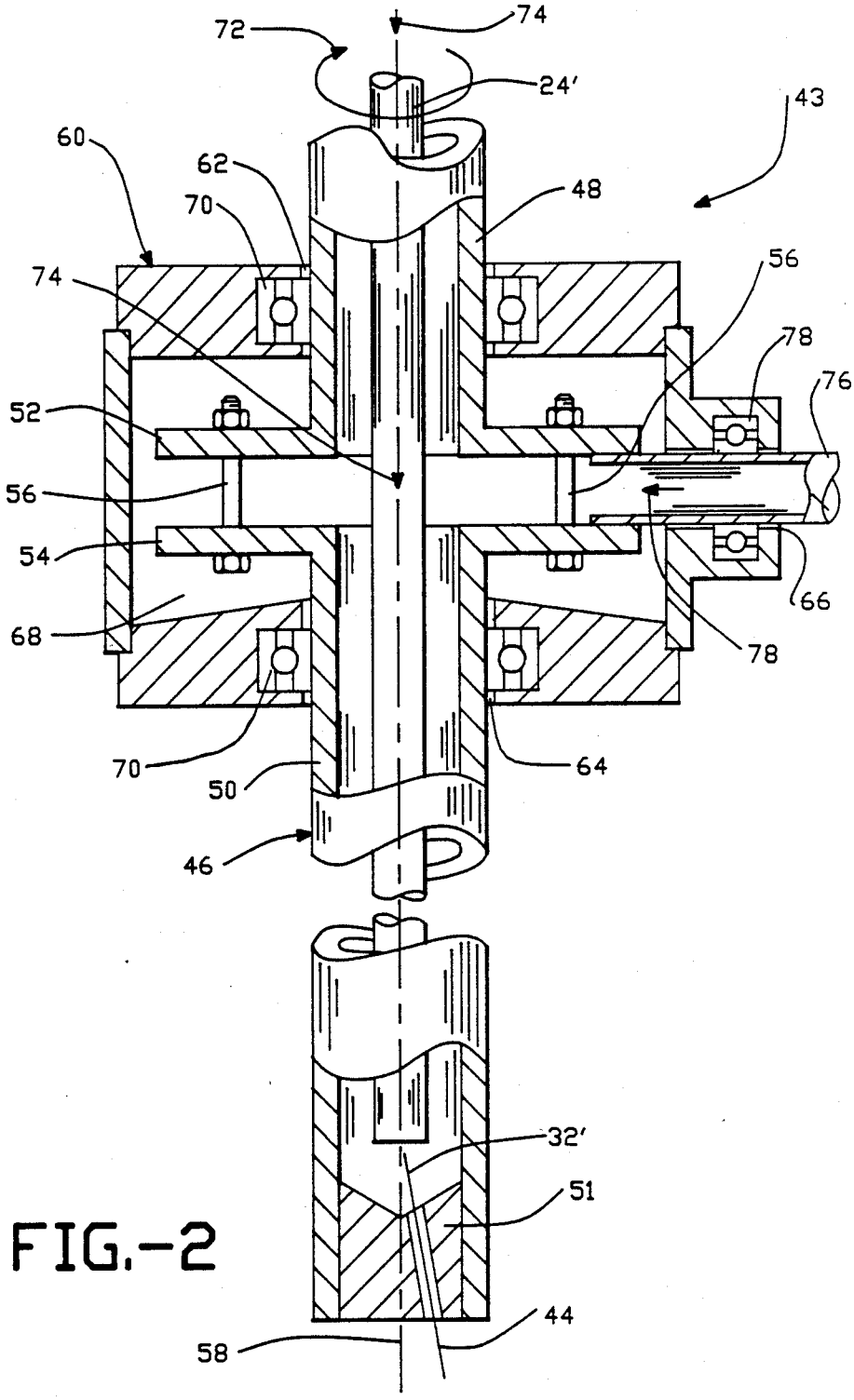
FIG. 2 is a longitudinal sectional view of an abrasive swivel assembly designed in accordance with a second embodiment of this invention.

Turning now to FIG. 2, attention is directed to an abrasive swivel assembly 43 which is designed in accordance with a second embodiment of the present invention for producing a rotating, particle-laden fluid cutting jet 44. Assembly 43 is shown including an end section 46 of a tubular arrangement which is connected to a suitable source of particle-free fluid, for example water under pressure, in the same manner as the tubular arrangement d®scribed with respect to FIG. 1. As illustrated in FIG. 2, tubular end section 46 is divided into two separate portions, a top portion 48 and an axially spaced bottom portion 50 which includes a nozzle 51 for producing cutting jet so that the latter is offset with respect to the axis 58 of the tubular section 46. The axially spaced-apart confronting ends of upper and lower tubular portions 48 and 50 include radially outwardly extending, confronting and axially spaced-apart flanges 52 and 54, respectively. These flanges and therefore the two tubular portions 48 and 50 are joined together by a plurality of bolts or other suitable fastening means positioned circumferentially around the tubular portions.

Tubular end section 46 is supported for rotation about its longitudinal axis 58 by means of a housing 60 positioned around a part of the tubular section including confronting ends of tubular portions 48 and 50 and confronting flanges 52 and 54, as illustrated. With the exception of openings 62 and 64 for accommodating tubular portions 48 and 50 and a third opening 66 to be discussed hereinafter, the housing 60 is entirely closed and stationary, thereby defining a closed interior chamber 68. The housing includes annular seal bearings 70 disposed around openings 62 nd 64 and engagable with tubular portions 48 and 50 for supporting these portions and therefore the entire tubular section 46 for rotation about axis 58 while at the same time fluid sealing openings 62 and 64 around tubular portions 48 and 50, respectively. While not shown in FIG. 2, swivel assembly 44 includes suitable means for rotating tubular section 46 about its longitudinal axis, as indicated by arrow 72. Rotating means similar to those described in conjunction with assembly 10 say, for example, be utilized.

With abrasive swivel assembly 43 described thus far, it should be apparent that particle-free fluid, for example water, from its source may be caused to flow in a tube 24' (corresponding to tube 24 in FIG. 1) through tubular end section 46, as indicated by arrow 74.

Still referring to FIG. 2, attention is now directed to the way in which 'articles are introduced into particle-free fluid stream 32 in order to ultimately provide particle-laden fluid jet 44. To this end, a suitable particle supply is provided and directed into and through a suitable tubular arrangement including a tubular end section 76. Tubular end section 76 extends through opening 66 in housing 60 so that its free end is disposed directly between confronting flanges 52 and 54, either in or out of direct contact with the flanges and at a point radially outward of tube 24. Suitable sealing means, for example annular seal 78, is positioned around opening 66 to seal closed opening around tubular end section 76. Similarly seals 64 and 62 are provided to eliminate ambient air entrainment into the chamber 68. Tubular end section 76 is used to introduce particles into the annular space between tubular section 46 and tube 24, as indicated by arrows 78. The particles are drawn into and mix with the stream 32 in nozzle 54 whose output is a particle-laden stream, thereby resulting in a particle-laden fluid jet 44.

Figure 3:
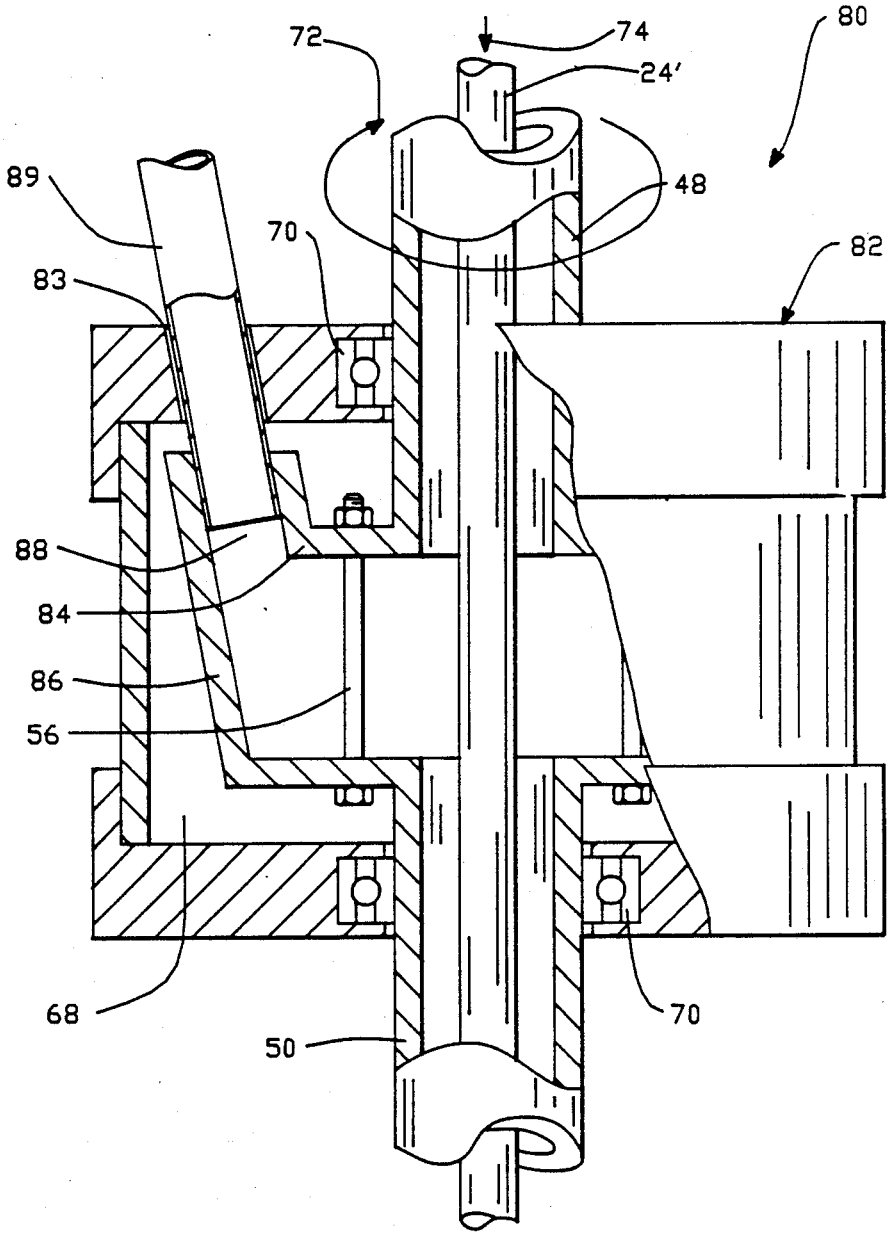
FIG. 3 is a longitudinal sectional view (in part) of an abrasive swivel assembly designed in accordance with a third embodiment of this invention.

Turning now to FIG. 3, attention is directed to an abrasive swivel assembly 80 which, as stated previously, is designed in accordance with a third embodiment of the present invention. Assembly 80 may be similar or identical to swivel assembly 43 in many respects. For example, swivel assembly 80 includes the same spaced-apart tubular portions 48 and 50, means for rotating the tubular portions in the same manner, as indicated by the arrow 72, and a housing 82 which may be identical to housing 60, except for the location of its third opening 83 which corresponds to previously described opening 66. This latter opening is located on the side of housing 60, as shown in FIG. 2. For reasons to become apparent hereinafter, opening 86 is disposed on top of housing 82, at an inclined angle with the horizontal. Otherwise, with one other possible exception to be noted, housing 82 may be identical to housing 60 and thus it may include interior chamber 68 and bearing seals 70. The other possible exception just mentioned resides in the space configuration of each chamber 68. The one illustrated in FIG. 3 is flat whereas the one shown in FIG. 2 extends radially downward and outward from tubular section 46. This is because some of the particles introduced into the housing shown in FIG. 2 falls to the bottom of that chamber. By sloping the base radially outward and downward, the particles falling to the bottom are directed outward and away from the rotating tubular section so as to prevent the particles from becoming lodged in opening 64 between the housing and rotating tubular portion 50. On the other hand, as will be seen hereinafter, it is very unlikely that particles will be present at the bottom of chamber 68 in swivel assembly 80. Therefore it is not necessary to provide a tapered bottom.

Still referring to FIG. 3, the remaining differences between this assembly and assembly 43 will now be described. As seen in FIG. 3, rather than flat confronting flanges, the tubular portions 48 and 50 include confronting flanges 84 and 86 which are configured to define an annular passage 88 disposed in housing 82 and positioned concentrically around tubular portions 48 and 50. Note also that passageway 88 extends upward at an incline so as to define, in effect a frustoconical configuration. Note further that although flanges 84 and 86 rotate with tubular portions 48 and 50, the passageway is always in axial alignment with previously recited passageway 84. One end section 89 of a tubular arrangement connected to a supply of particulate material is disposed within opening 83 and passage 88.

The way in which swivel assembly 80 functions is identical to swivel assembly 43 to provide a rotating, particle-laden fluid jet.

Figure 4:
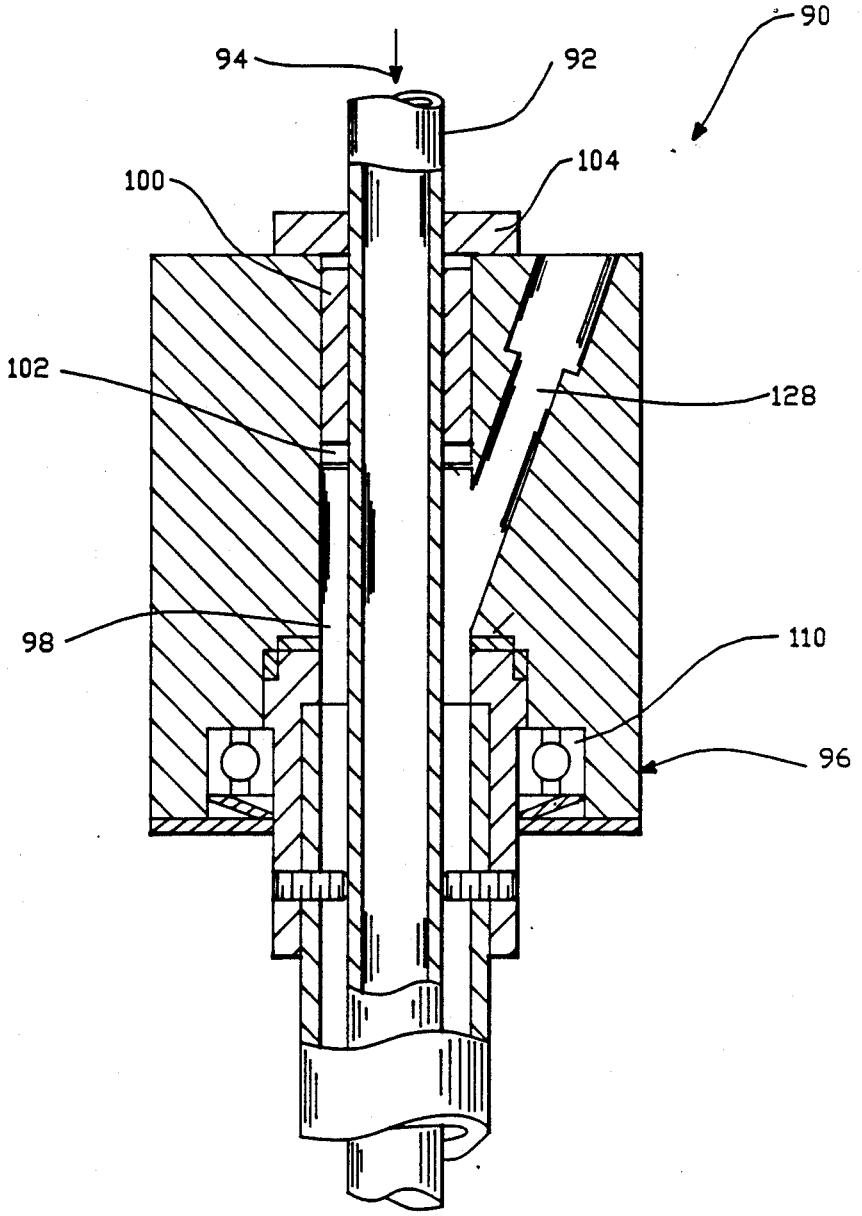
FIG. 4 is a longitudinal sectional view of an abrasive swivel assembly designed in accordance with a fourth, preferred embodiment of this invention.
Figure 5:
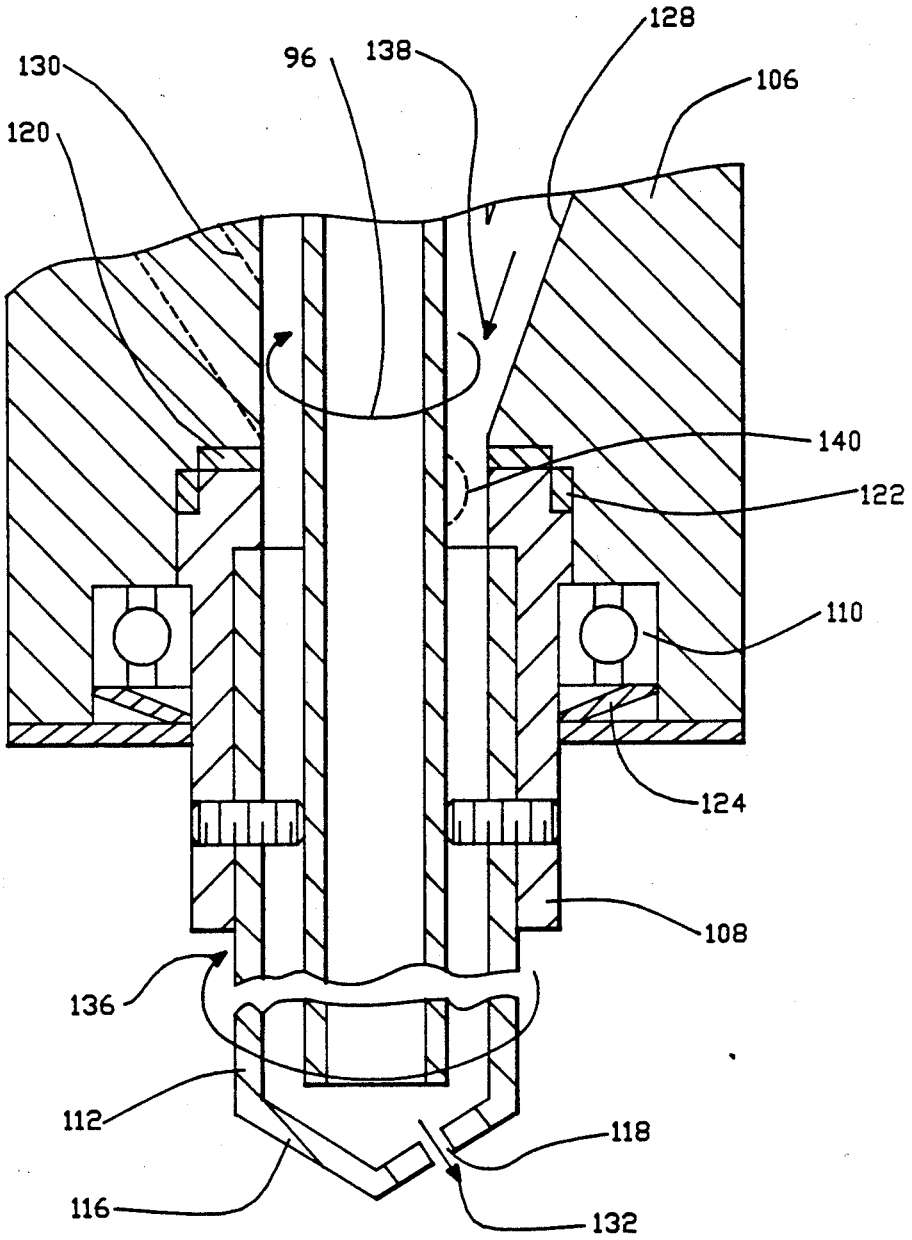
FIG. 5 is an enlarged view of a portion of the swivel assembly of FIG. 4, specifically illustrating the assembly in combination with a fluid jet producing arrangement.

Turning now to FIGS. 4 and 5, attention is directed to an abrasive swivel assembly 90 designed in accordance with a fourth and preferred embodiment of the present invention. Like the previously described assemblies, assembly 90 include what may be referred to as a primary tubular arrangement including a straight tubular section 92 connected to a source of pressurized, particle-free fluid such that a stream of particle-free fluid passes therethrough as indicated by arrow 94. Straight tubular section 92 is supported for rotation about its own longitudinal axis by means of a sleeve arrangement 96 to be described below. For the moment it suffices to say that overall assembly 90 includes suitable means such as those previously described for rotating tubular section 92 about its own longitudinal axis, as indicated by arrow 96 in FIG. 5.

Still referring to FIG. 4 in conjunction with FIG. 5, overall sleeve arrangement 96 is shown positioned concentrically around a segment of tubular section 92 so as to define a longitudinally extending, annular cavity 98 therebetween. One end of sleeve arrangement 96 supports tubular section 92 for rotation about its longitudinal axis and, to this end, includes sleeve bearing 100 at one end of cavity 98. For reasons to become apparent hereinafter, an annular abrasive seal 102 is disposed between sleeve bearing 100 and the end of cavity 98. In addition, an annular vacuum seal 104 may be provided around tubular section 92 adjacent the opposite end of sleeve bearing 100.

As best illustrated in FIG. 5, overall sleeve arrangement 96 is formed from two parts, a stationary part 106 and a rotating part 108. The stationary part contains the above-recited sleeve bearing 100 and defines a top longitudinal segment of cavity 98. The rotating sleeve part 108 is disposed partially within stationary part 96 and is supported for rotation therein by means of bearing 110. Rotatable sleeve part 108 is positioned concentrically around and defines a second, lower segment of cavity 98. Moreover, it is fixedly connected with and circumscribes a stem 112 which is recessed within rotating part member 108 so as not to project within cavity 98. Both the stem 112 and rotating part 108 are connected for rotation with tubular section 92 by means of a plurality of circumferentially spaced et screws 114. The bottom end of stem 112 extends beyond the tubular section 92 and includes a closure 116 containing an offset nozzle 118 in a manner similar to assembly 42 described in conjunction with FIG. 2.

As described thus far, overall assembly 90 is configured such that rotation of tubular section 92 about its longitudinal axis causes the part 108 of sleeve arrangement 96 and stem 112 including bottom portion 116 and nozzle 118 to rotate with it. In this regard and for reasons to be apparent hereinafter, an abrasive seal 120 similar to previously recited seal 102 but not protruding within cavity 98 is positioned concentrically around the cavity between rotatable part 108 and stationary part 106. In addition, a vacuum seal 122 similar to vacuum seal 104 may be provided behind abrasive seal 120, as shown in FIG. 5. Finally, with regard to the structural aspects of sleeve arrangement 96, in a preferred embodiment, the bearing 110 is spring-loaded by means of O-ring spring 124 to urge movable part 108 of the sleeve arrangement against the abrasive seal 120 in order to preload the latter.

Returning to FIG. 4, stationary part 106 of overall sleeve arrangement 96 is shown including a port 128 which could be angled or normal to the tube 92. The upper end of the port is adapted for connection to a supply of particles. Similar additional ports can also be provided in stationary part 106, as indicated diagrammatically by means of dotted lines at 130 in FIG. 5.

Having now described overall swivel assembly 90 from a structural standpoint, attention is directed to the way in which it is operated to produce a rotating, particle-laden fluid jet at the output of nozzle 118, as indicated by arrow 132. As in the other embodiments, the tubular section 92 is provided with a stream of particle-free fluid under pressure from a suitable source, as indicated by arrows 134. At the same time, the tubular section 92 is caused to rotate about its own axis, thereby causing part 108 of sleeve arrangement 96 and stem 112 to rotate with it, as indicated by arrow 136. While these components are rotating, particles are introduced into cavity 98 through port 128 and/or the additional ports if such additional ports are provided, as indicated by arrows 138. The particles are introduced into the cavity, either dry or entrained in a fluid medium (either gas or liquid). In any event, the particles pass through the cavity and eventually mix with the particle-free fluid stream in an area upstream of nozzle 118. In that way, the particle-laden stream of fluid is presented to the nozzle in order to produce particle-laden jet 132.

An important feature of overall swivel assembly 90 resides in the configuration of its cavity 98, inlet port 128 and the opening from the inlet port to the cavity. More specifically, by making the cross-sectional configuration of the cavity itself uniform along its entire length and by making the cross-sectional area of the cavity, the cross-sectional area of the port and the area of the opening between the port and cavity approximately the same, that is, so that they differ by at most a factor of two, the particles will enter and pass through the cavity in a relatively turbulent-free manner and with minimal wear to the components of the swivel assembly exposed to the particles. In this regard, the area most susceptible to wear resides in the external surface of rotating tubular section 92 just below the entry to the cavity from port 128. This area which is shown at 140 by dotted lines may be coated with a protective sleeve of, for example, tungsten carbide or ceramics. Because of the configuration of the cavity and inlet port, minimal clogging occurs throughout the cavity as the particles pass therethrough and with minimal turbulence.

What is claimed is:

1. An assembly for providing a rotating, particle-laden fluid jet, comprising:

(a) tube means including a straight inner tube for containing within its interior a stream of particle-free fluid which flows from an upstream pressurized source of said fluid through the inner tube and out the downstream end of said tube, said tube means also including a straight tubular section surrounding said inner tube;

(b) means for rotating said straight tubular section of said tube means about the longitudinal axis of said straight tubular section;

(c) means for introducing solid particles into said at a point along said rotating straight tubular section so as to cause said particles to mix with said fluid stream at the downstream end of said tube, whereby to produce particle-laden fluid stream; and (d) means for forming a rotating jet from said particle-laden stream; and (e) said straight tubular section of said tube means including a pair of spaced apart longitudinal subsections having confronting flanges and bolts coupling said flange means and therefore said subsections for rotation by said rotating means.

2. An assembly according to claim 1 wherein said means for introducing said particles into said stream includes:

(a) an annular opening defined by said flange means and circumscribing said longitudinal subsections of said tubular means; and (b) stationary tube means in fluid communication with said annular opening for directing said particles from an external supply into said opening and into the interior of said tube means.

3. An assembly according to claim 2 wherein said flange means includes means for defining said annular opening such that the latter extends longitudinally at an acute angle with said tube means.

4. An assembly according to claim 2 wherein said flange means includes means for defining said annular opening such that the latter extends longitudinally at a 90 angle with said tube means.

5. An assembly for providing a rotating, particle-laden fluid jet comprising:

(a) means for containing a particle-free stream of fluid;

(b) means for introducing particles into said particle-free stream, whereby to produce a particle-free stream, whereby to produce a particle-laden fluid stream; and (c) means for forming a rotating jet from said particle-laden stream; and (d) said means for containing said particle-free stream including a tube carrying said last-mentioned stream and said means for forming said rotating jet including a housing containing one end section of said tube for receiving said last-mentioned stream and means for rotating said housing about a given axis, and said means for introducing particles into said rotating stream including an opening into said rotating housing.

6. An assembly according to claim 5 wherein said housing extends longitudinally along said given axis and includes a passageway out of the housing from its interior for passage of said particle-laden fluid stream whereby to form said jet and thereby serve as said jet-forming means.

7. An assembly according to claim 6 wherein said passageway is offset with respect to said given axis.

* * * * *

UNITED STATES PATENT AND TRADEMARK OFFICE

CERTIFICATE OF CORRECTION

PATENT NO. : 4,936,059

DATED : June 26, 1990

INVENTOR(S) : Mohamed Hashish and Mark Marvin

It is certified that error appears in the above-identified patent and that said Letters Patent is hereby corrected as shown below:

Col. 3, line 60, delete "j®t" and insert ---jet---;

Col. 4, line 5, delete "d®scribed" and insert ---described---;

Col. 4, line 38, delete "say" and insert ---may---;

Col. 4, line 45, delete "'articles" and insert ---particles---;

Col. 4, line 62, delete "32" and insert ---32'---; and

Col. 6, line 24, delete "et" and insert ---set---.

Signed and Sealed this

Eighth Day of October, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,936,059

DATED : June 26, 1990

INVENTOR(S) : Mohamed Hashish and Mark Marvin

It is certified that error appears in the above-identified patent and that said Letters Patent is hereby corrected as shown below:

Column 1, line 4, insert

---This invention was made with Government support under Contract DE-AC03-84ER80192 Phase II awarded by the DEPARTMENT OF ENERGY. The Government has certain rights in this invention.---

Signed and Sealed this

Twentieth Day of April, 1993

*Attest:*

MICHAEL K. KIRK

*Attesting Officer*

*Acting Commissioner of Patents and Trademarks*